United States Patent [19]

Otobe

[11] Patent Number: 4,570,592

[45] Date of Patent: Feb. 18, 1986

[54] METHOD OF FEEDBACK-CONTROLLING IDLING SPEED OF INTERNAL COMBUSTION ENGINE

[75] Inventor: Yutaka Otobe, Shiki, Japan

[73] Assignee: Honda Giken Kogyo Kabushiki Kaisha, Tokyo, Japan

[21] Appl. No.: 693,088

[22] Filed: Jan. 22, 1985

[51] Int. Cl.[4] ..... F02M 3/07

[52] U.S. Cl. ..... 123/339; 123/585

[58] Field of Search ..... 123/327, 339, 493, 585

[56] References Cited

U.S. PATENT DOCUMENTS

| | | | |
|---|---|---|---|
| 4,465,043 | 8/1984 | Denz et al. | 123/339 X |
| 4,491,107 | 1/1985 | Hasegawa et al. | 123/339 |
| 4,508,074 | 4/1985 | Yamato et al. | 123/585 X |
| 4,524,738 | 6/1985 | Chastagner | 123/339 |

FOREIGN PATENT DOCUMENTS

| | | | |
|---|---|---|---|
| 146025 | 11/1981 | Japan | 123/339 |
| 88242 | 6/1982 | Japan | 123/339 |

*Primary Examiner*—Tony M. Argenbright

*Attorney, Agent, or Firm*—Armstrong, Nikaido, Marmelstein & Kubovcik

[57] ABSTRACT

A method of feedback controlling idling speed in an internal combustion engine having an intake air amount control unit for controlling the amount of air intake. During an idling operation, the intake air amount control unit is feedback controlled as a function of the deviation of actual engine speed from a target engine speed, and when the engine speed becomes lower than a predetermined speed while said engine is decelerating, the intake air amount control unit is set to an initial value prior to or at the start of the feedback control. The method includes the steps of detecting the engine speed; detecting the rate of deceleration of the engine when the detected engine speed becomes lower than the predetermined speed while the engine is decelerating; and setting the initial value of the intake air amount control unit as a function of the rate of deceleration. The intake air amount control unit is maintained at the initial value during the period of time from when the engine speed becomes lower than the predetermined speed to when feedback control starts.

4 Claims, 6 Drawing Figures

1
Me ≧ MA
NO
YES
3
θth ≦ θIDL
NO
YES
CLUTCH SW OFF
4
NO
ENGAGE
IN NEUTRAL POSITION
YES
DISENGAGE
5
YES
NO
7
DETERMINE MH
8
Me ≧ MH
NO
YES
9
YES
FEEDBACK MADE INPRECEDING LOOP
NO
2
STOP MODE CALCULATE DOUT (=0)
10
FEEDBACK MODE CALCULATE DOUT
6
DECELERATION MODE CALCULATE DOUT
OUTPUT ROUTINE OF CONTROL VLV
11

METHOD OF FEEDBACK-CONTROLLING IDLING SPEED OF INTERNAL COMBUSTION ENGINE

BACKGROUND OF THE INVENTION

1. Field of the Invention

The present invention relates to a method of feedback-controlling the idling speed of an internal combustion engine, and more particularly to an internal combustion engine idling speed feedback control method in which the engine operation is smoothly shifted from a deceleration state in which the throttle valve is fully closed to an engine operating condition controlled by an idling speed feedback control, thereby improving the engine operating performance.

2. Description of the Prior Art

Hitherto, an idling speed feedback control method has been used in which a target idling speed is set in accordance with load conditions of an engine, and the difference between the target idling speed and an actual engine speed is detected. The amount of auxiliary air to be sucked into the engine is then adjusted in accordance with the magnitude of the difference such that the difference becomes zero, thereby maintaining the engine speed at the target idling speed (e.g., Japanese Patent Laid-Open No. 98,628/80).

When the engine operating state is shifted from a deceleration state wherein the throttle valve is fully closed to an idling state, if the auxiliary air amount control is commenced by the above-described feedback control at the time when the engine speed becomes lower than the target idling speed, the engine speed drops below the target idling speed due to a delay in the feedback control. Thus, the engine may stall when there is a sudden drop in speed. In order to overcome this disadvantage, a method has been proposed in which the amount of auxiliary air required for maintaining the engine speed at the target idling speed is supplied to the engine during deceleration, before the feedback control is commenced.

In general, when the deceleration is effected, wherein the throttle valve is fully closed, the charging efficiency of the engine is small, and the charging efficiency decreases as the rate of deceleration of the engine increases. This fact becomes more conspicuous as the volume of the chamber of the intake manifold is increased in order to increase the charging efficiency in a heavy-load operation, such as an internal combustion engine equipped with, for example, an electronic fuel injection device. For this reason, even if an amount of air corresponding to the target idling speed is supplied during deceleration as described above, when the rate of deceleration is large, since the charging efficiency becomes smaller, the engine speed may disadvantageously overshoot below the target idling speed by a large margin when the control is shifted to the idling speed feedback control.

SUMMARY OF THE INVENTION

In view of the above-described disadvantages, it is a primary object of the present invention to avoid overshooting of the engine speed when engine operation is shifted from a deceleration state in which the throttle valve is fully closed to engine operation controlled by the idling speed feedback control, regardless of the rate of deceleration of the engine. To this end, according to the present invention, there is provided a method of feedback-controlling the idling speed of an internal combustion engine in which, during idling of the internal combustion engine, the intake air amount control means, which adjusts the amount of intake air, is feedback controlled in accordance with the deviation of an actual engine speed from a target idling speed. When the engine speed becomes lower than a predetermined speed during a decelerating state, wherein the engine is decelerated toward a feedback control state and the feedback control is commenced, the intake air amount control means is set at an initial value prior to the time of starting of the feedback control. The method includes the improvement comprising the steps of: detecting an engine speed; detecting the rate of deceleration of the engine speed at the time when the detected engine speed value becomes lower than the predetermined speed while the engine is in the deceleration state; and setting the initial value of the intake air amount control means in accordance with the detected rate of deceleration.

DETAILED DESCRIPTION OF THE PREFERRED EMBODIMENT

Figure 1:
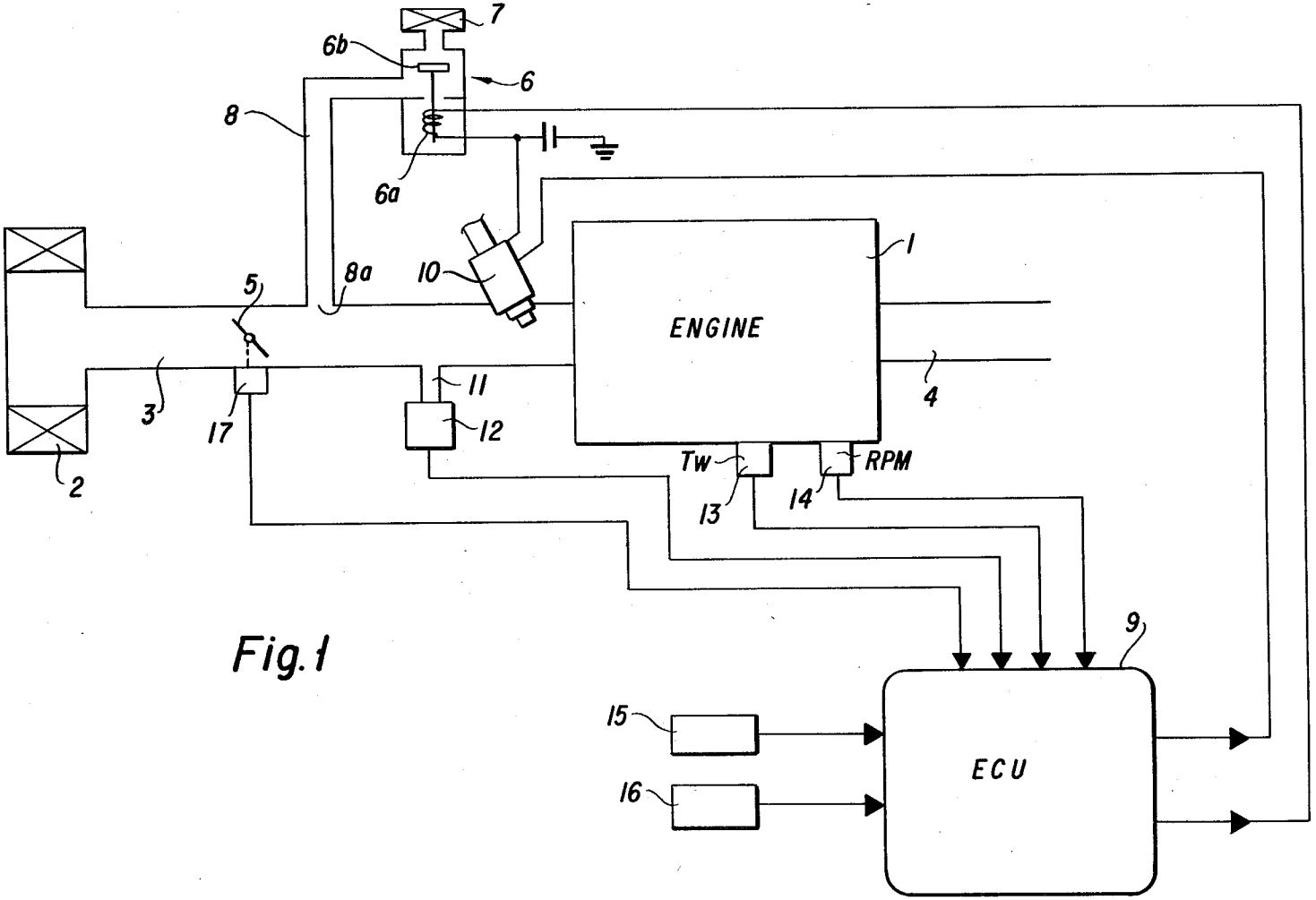
FIG. 1 is schematic diagram of an intake air controller for an internal combustion engine to which the control method of the present invention is applied.

FIG. 1 schematically shows an engine speed controller for an internal combustion engine to which the method of present invention is applied. A four cylinder internal combustion engine 1 is connected to an intake pipe 3 having an air cleaner 2 mounted at its forward end and an exhaust pipe 4 is connected to its rear end. A throttle valve 5 is disposed in the intake pipe 3. Further, an air passage 8 is provided which has one end 8*a* opening to a portion of the intake pipe 3 on the downstream side of the throttle valve 5 and the other end communicating with the atmosphere through an air cleaner 7. An auxiliary air amount control valve 6 (referred to simply as a "control valve", hereinafter) is disposed in an intermediate portion of the air passage 8. The control valve 6 controls the amount of auxiliary air supplied to the engine 1. The control valve 6 comprises a normally-closed type electromagnetic valve which is composed of a solenoid 6*a* and a valve 6*b* which opens the air passage 8 when the solenoid 6*a* is energized. The solenoid 6*a* is electrically connected to an electronic control unit (ECU) 9.

A fuel injection valve 10 is arranged to project into the intake pipe 3 at a location between the engine 1 and the opening 8*a* of the air passage 8. The fuel injection valve 10 is connected to a fuel pump (not shown), and also is electrically connected to the ECU 9.

A throttle valve opening sensor 17 is attached to the throttle valve 5. An intake manifold absolute pressure sensor 12 which communicates with the intake pipe 3 through a pipe 11 is provided in the intake pipe 3 on the downstream side of the opening 8*a* of the air passage 8. Further, an engine coolant temperature sensor 13 and an engine rpm sensor 14 are attached to the body of the engine 1. These sensors are electrically connected to the ECU 9. The clutch switch 15 and neutral switch 16 are also electrically connected to the ECU 9.

Various engine operation parameter signals are supplied to the ECU 9 from the throttle valve opening sensor 17, the intake manifold absolute pressure sensor 12, the coolant temperature sensor 13 and the engine rpm sensor 14, together with ON-OFF signals from the switches 15 and 16. On the basis of these engine operating condition parameter signals and the generating state signal, the ECU 9 determines engine operating conditions and engine load conditions, such as electrical load conditions, and sets a target idling speed in accordance with these determined conditions. The ECU 9 further calculates the amount of fuel to be supplied to the engine 1, that is, a valve-opening duration for the fuel injection valve 10, and also the amount of auxiliary air to be supplied to the engine 1, that is, a valve-opening duty ratio of the control valve 6. The ECU supplies respective driving signals to the fuel injection valve 10 and the control valve 6 in accordance with the respective calculated values.

The solenoid 6*a* of the control valve 6 is energized over a valve-opening duration corresponding to the calculated valve-opening duty ratio, to open the valve 6*b*, thereby opening the air passage 8, whereby a necessary amount of auxiliary air corresponding to the calculated valve-opening duration is supplied to the engine 1 through the air passage 8 and the intake pipe 3.

The fuel injection valve 10 is opened over a valve-opening duration corresponding to the above-described calculated value in order to inject fuel into the intake pipe 3. The ECU 9 operates to supply an air/fuel mixture having a desired air/fuel ratio, e.g. a stoichiometric air/fuel ratio to the engine 1.

When the valve-opening duration of the control valve 6 is increased to increase the amount of auxiliary air, an increased amount of the air/fuel mixture is supplied to the engine 1 thereby increasing the engine output, resulting in a rise in the engine speed. Conversely, when the valve-opening duration of the control valve 6 is decreased, the amount of air/fuel mixture supplied is decreased, resulting in a decrease in the engine speed. Thus, it is possible to control the engine speed by controlling the amount of auxiliary air, that is, the valve-opening duration of the control valve 6.

Figure 2:
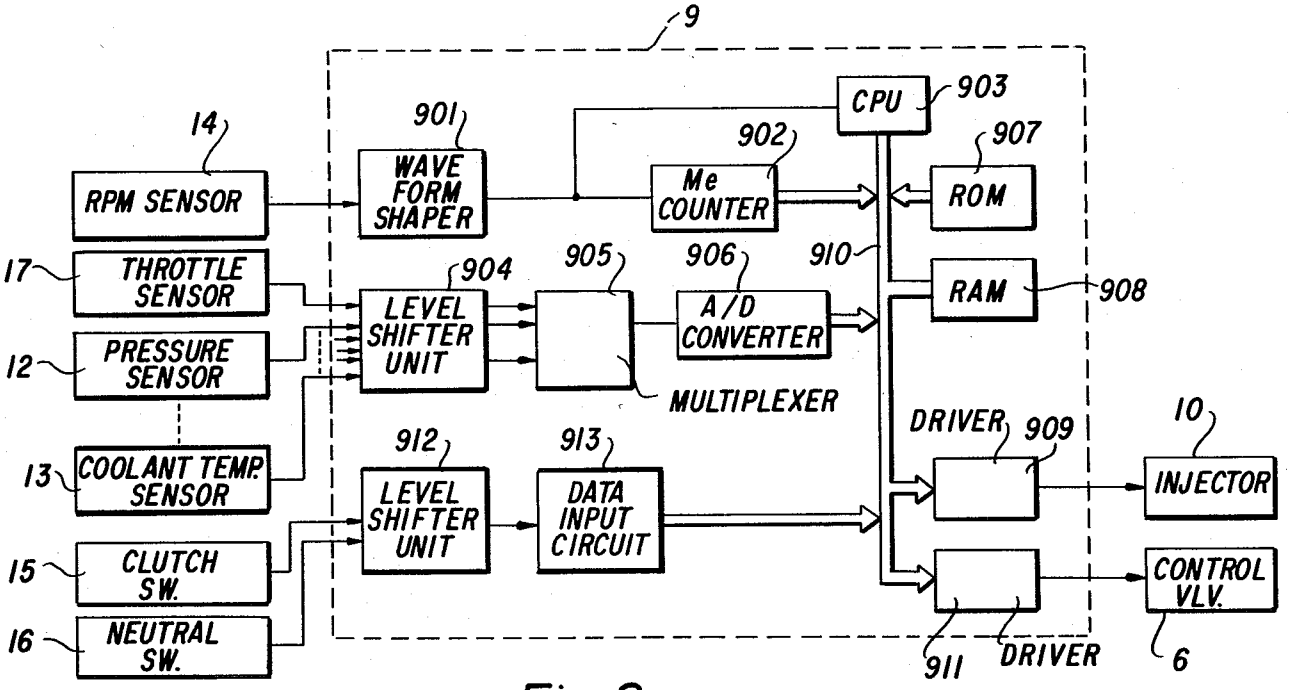
FIG. 2 is a block diagram of an electronic control unit shown in FIG. 1.

FIG. 2 shows a circuit diagram of the ECU 9 shown in FIG. 1. An output signal from the engine rpm sensor 14 is applied to a waveform shaping circuit 901 and is then supplied to a central processing united (CPU) 903 and also to a $M_e$ counter 902 as a TDC signal representing a predetermined angle of the crank angle, for example, the top dead center. The $M_e$ counter 902 counts the interval of time from the preceding pulse of a TDC signal of the engine rpm sensor 14 to the present pulse of a TDC signal, and therefore, the count $M_e$ is inversely proportional to the engine speed $N_e$. The $M_e$ counter 902 supplies the counted value $M_e$ to the CPU 903 via a data bus 910.

Output signals from various sensors, such as the throttle valve opening sensor 17, the intake manifold absolute pressure sensor 12 and the engine coolant temperature sensor 13, which are shown in FIG. 1, are modified to a predetermined voltage level in a level shifter unit 904 and are then successively applied to an A/D converter 906 by means of a multiplexer 905. The A/D converter 906 successively converts the signals from the sensors 12, 13 and 17 into digital signals and supplies the digital signals to the CPU 903 via the data bus 910.

Each of the ON-OFF signals delivered respectively from the clutch switch (SW) 15 and the neutral switch (SW) 16 is shifted to a predetermined voltage level in a level shifter unit 912 and is then converted into a predetermined signal in a data input circuit 913 and is supplied to the CPU 903 via the data bus 910.

The CPU 903 is further connected via the data bus 910 to a read only memory (ROM) 907, a random-access memory (RAM) 908, and driving circuits 909 and 911. The RAM 908 temporarily stores, for example, the results of the calculation carried out in the CPU 903 and various sensor outputs. The ROM 907 stores a control program executed in the CPU 903 and a valve-opening duty ratio $D_{EX}$ table as a reference correction value, described below.

The CPU 903 executes the control program stored in the ROM 907, the CPU 903 calculates engine operating conditions and engine load conditions on the basis of the above-described various engine parameters and generating state signal, and calculates a valve-opening duty ratio $D_{OUT}$ for the control valve 6 which controls the amount of auxiliary air. The CPU 903 then supplies the driving circuit 911 with a control signal corresponding to the calculated value.

The CPU 903 further calculates a fuel injection duration $T_{OUT}$ for the fuel injection valve 10 and supplies a control signal based on the calculated value to the driving 909 via the data bus 910. The driving circuit 909 supplies the fuel injection valve 10 with a control signal, which opens the fuel injection valve 10, in accordance with the calculated value. The driving circuit 911 supplies the control valve 6 with an ON-OFF driving signal which controls the control valve 6.

Figure 3:
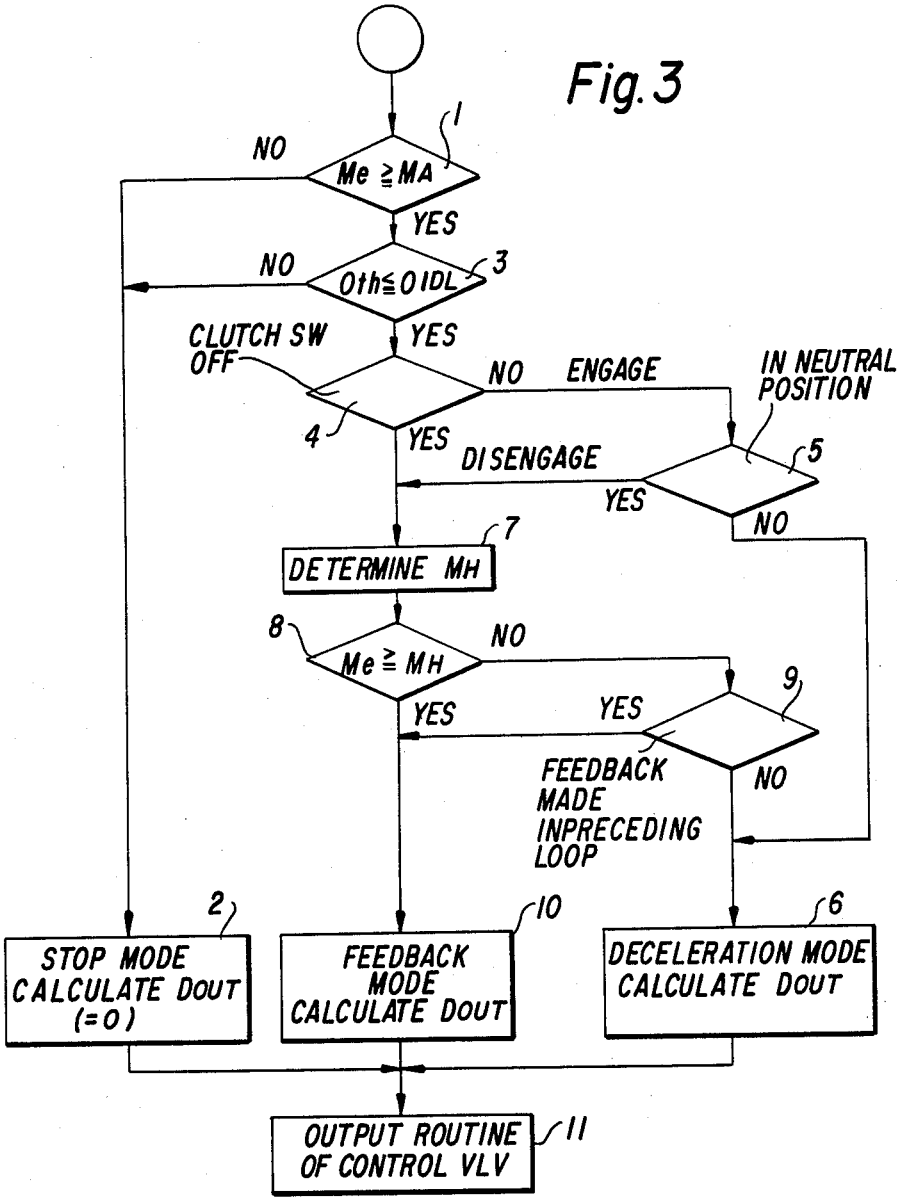
FIG. 3 is a flow chart of a main routine for auxiliary air amount control in accordance with the present invention.

FIG. 3 is a flow chart showing the control procedure of a main routine for the auxiliary air amount control by the control valve 6 executed in the above-described CPU 903 every time a TDC signal pulse is generated.

According to the control program shown in FIG. 3, a decision is made as to whether or not a value $M_e$ which is proportional to the reciprocal of an engine speed $N_e$ is larger than a value $M_A$ which is proportional to the reciprocal of a predetermined engine speed $N_A$ (e.g., 1,500 rpm) (step 1). If the result of the decision is negative (No), that is, if the engine speed $N_e$ is higher than the predetermined speed $N_A$, there is no need to supply auxiliary air to the engine. Therefore, the process proceeds to step 2, in which a valve-opening duty ratio $D_{OUT}$ is set to zero (this will be referred to as a "stop mode", hereinafter).

When the engine speed drops such that the result of the decision in step 1 is affirmative (Yes), that is, when the engine speed $N_e$ becomes lower than the predetermined speed $N_A$, the process proceeds to step 3, in which a decision is made as to whether or not the opening $\theta_{th}$ of the throttle valve 5 is smaller than a predetermined opening $\theta_{IDL}$ which represents the fact that the throttle valve 5 is substantially fully closed.

If the result of decision in step 3 is negative (No), that is, if $\theta_{th} > \theta_{IDL}$ is valid, the amount of intake air passing through the throttle valve 5 is a sufficient amount of air to be supplied to the engine. Therefore, the process proceeds to the above-described step 2.

If the result of the decision in step 3 is affirmative (Yes), that is, if $\theta_{th} \leqq \theta_{IDL}$ is valid, in subsequent steps 4 and 5, decisions are respectively made as to whether or not the clutch switch 15 is OFF and as to whether or not the neutral switch 16 is ON. The clutch switch 15 provides the ECU 9 with an ON signal when the clutch is in an engaged state, while the neutral switch 16 provides the ECU 9 with an ON signal when the transmission gear is in a neutral position. Accordingly, if the results of the respective decisions in steps 4 and 5 are both negative (No), it shows that the drive shaft of the engine and a wheel are in an engaged state. The process thus proceeds to step 6, in which the valve-opening duty ratio $D_{OUT}$ is controlled by the deceleration mode and is calculated as $D_{OUT}=D_X$, where $D_X$ represents a deceleration mode term, which is determined in a $D_X$ determination subroutine shown in FIG. 5, and described below.

For the following reason, the valve-opening duty ratio $D_{OUT}$ is thus determined by the deceleration mode rather than by a feedback mode, described below, when the engine drive shaft and the wheel are in an engaged state.

If the engine speed $N_e$ is lowered along a throttle valve fully closed line I shown in FIG. 4 without effecting the auxiliary air amount control by the deceleration mode, the auxiliary air amount control by the feedback mode, described below, is executed at a point a when the engine $N_e$ becomes lower than the target idling speed $N_H$. In consequence, the engine speed $N_e$ drops along a curve I' and then settles at an idling point A.

Figure 4:
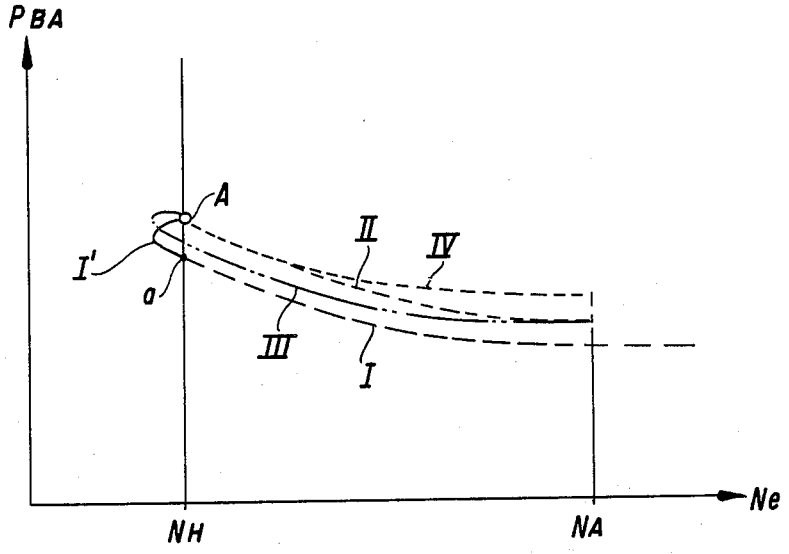
FIG. 4 is a graph showing how the operating state of the engine is changed as a function auxiliary air control in a deceleration mode.

In order to avoid the overshooting of the engine speed along the curve I', when the engine speed $N_e$ becomes lower than the predetermined speed $N_A$, an amount of auxiliary air is set which is required for maintaining the engine speed during the idling at the target idling speed $N_H$, and the set amount of auxiliary air is previously supplied to the engine, whereby the engine speed decreases along an operation line II shown in FIG. 4 and reaches the idling point A without overshooting. For this reason, the calculation of the valve-opening duty ratio $D_{OUT}$ in the deceleration mode executed in step 6 is carried out such that the value of the ratio $D_{OUT}$ is set at the valve-opening duty ratio $D_X$ corresponding to the above-described amount of auxiliary air.

If the result of the decision in either step 4 or 5 is affirmative (Yes), it shows that the engine drive shaft and the wheel are in a disengaged state. In such a case, the process proceeds to step 7, in which a value $M_H$ is set which is proportional to the reciprocal of the target idling speed $N_H$ (e.g., 650 rpm), and the process proceeds to step 8. The value $M_H$ is set at a value at which the engine is stably operated in accordance with the engine load during the idling operation on the basis of detection signals delivered from the engine coolant temperature sensor 13 and other sensors.

In step 8, a decision is made as to whether or not the value $M_e$ which is proportional to the reciprocal of the engine speed $N_e$ is larger than the value $M_H$ obtained in step 7. If the result of the decision is negative (No), that is, if the engine speed $N_e$ is higher than the target idling speed $N_H$, the process proceeds to step 9, in which a decision is made as to whether or not the preceding loop was not effected by the feedback mode (if the result of the decision is negative (No)), the process proceeds to the above described step 6.

Figure 6:
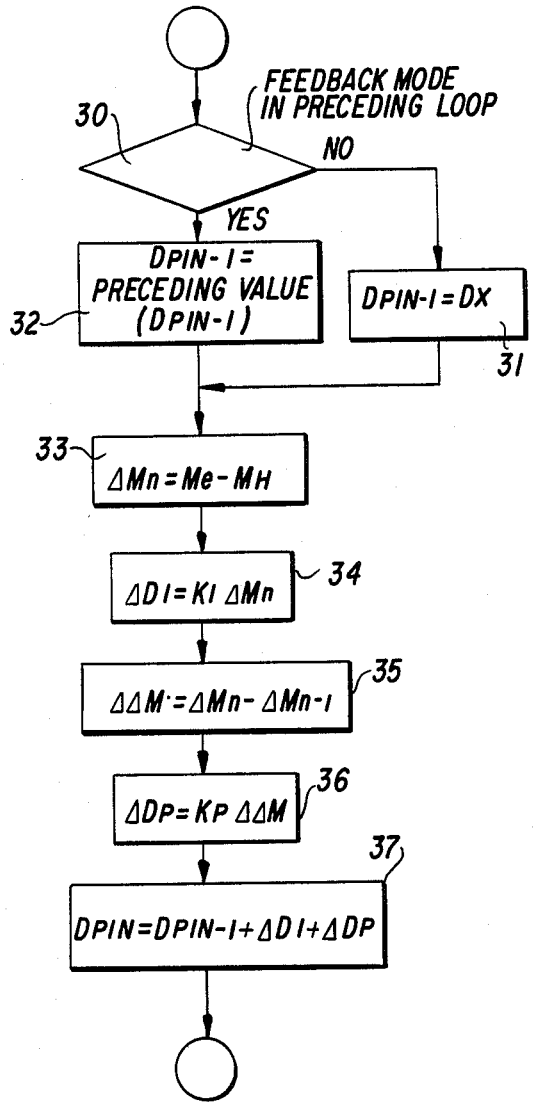
FIG. 6 is a flow chart of a $D_{PIn}$ determination subroutine.

If the result of the decision in step 8 is affirmative (Yes), or if the result of the decision in step 9 is affirmative (Yes), the process proceeds to a step 10, in which the valve-opening duty ratio $D_{OUT}$ in the control by the feedback mode is calculated as $D_{OUT}=D_{PIn}$, where $D_{PIn}$ represents a feedback mode term which is set by a PI proportional and integral control and is determined by a $D_{PIn}$ determination subroutine shown in FIG. 6. Accordingly, when the decreasing engine speed $N_e$ becomes lower than the target idling speed $N_H$, the result of the decision in step 8 becomes affirmative (Yes), and the idling speed feedback control is commenced. After the feedback control is started there is no longer any need for the auxiliary air amount control in the deceleration mode even if the engine speed $N_e$ temporarily increases such that the result of the decision in step 8 becomes negative (No). Accordingly, when the result of the decision in step 8 is affirmative (Yes), the feedback control is continued.

After the valve-opening duty ratio $D_{OUT}$ has been calculated in steps 2, 6, or 10, the process proceeds to a control valve output routine (step 11), in which the control valve 6 is driven at the duty ratio $D_{OUT}$.

Figure 5:
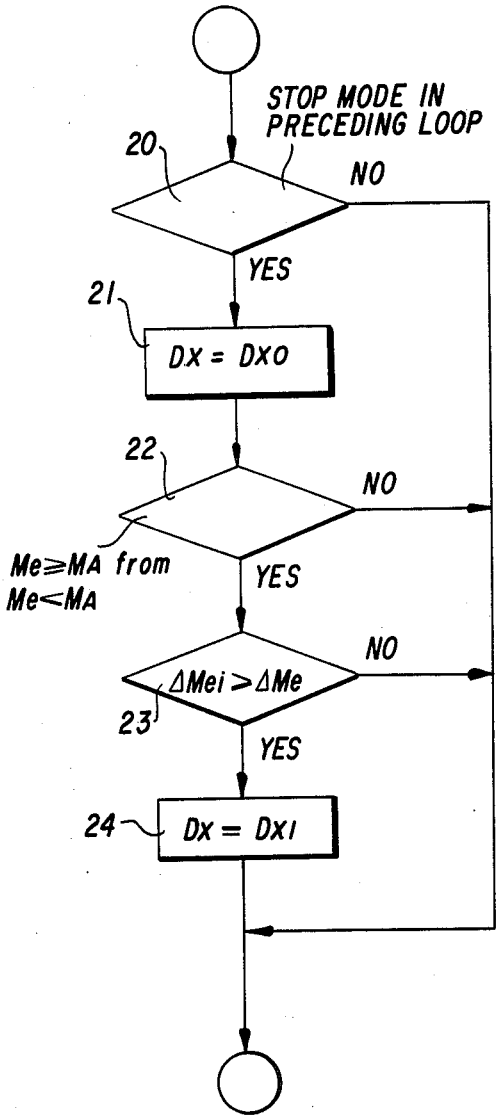
FIG. 5 is a flow chart of a $D_X$ determination subroutine in accordance with the present invention.

FIG. 5 is a flow chart of the $D_X$ determination subroutine executed in step 6 of FIG. 3. According to this program, a decision is made as to whether or not the preceding loop was effected by the stop mode (step 20). If the result of decision is affirmative (Yes), that is, if the engine speed $N_e$ at the time when the preceding TDC signal pulse was generated was higher than the predetermined speed $N_A$ (1,500 rpm), or if the throttle valve opening $\theta_{th}$ was larger than the predetermined opening $\theta_{IDL}$, the process proceeds to a step 21, in which the value of the deceleration mode term $D_X$ is set at a value $D_{X0}$ for a slow-deceleration operation (e.g., 50%).

Next, a decision is made as to whether or not the present loop is an initial loop in which the engine speed $N_e$ has decreased below the predetermined speed $N_A$ (step 22). This decision is effected by making a decision as to whether or not $M_e < M_A$ was valid in the preceding loop and $M_e \geqq M_A$ is valid in the present loop. If the result of the decision is affirmative (Yes), that is, if it is decided that the engine speed Ne is below the predetermined speed $N_A$ in the present loop for the first time, a decision is made from the rate of deceleration of the engine speed as to whether or not the engine operation is a sudden deceleration operation (step 23).

This decision is effected by making a determination as to whether or not the difference $\Delta M_{en}=M_{en}-M_{en-1}$ between the $M_{en}$ value, at the time when the present TDC signal pulse is generated and the $M_{en-1}$ value at the time when the preceding TDC signal pulse was generated, is larger than a predetermined value $\Delta M_{e1}$ (e.g., 3 ms).

If the result of decision in step 23 is affirmative (Yes), that is, if the rate of deceleration of the engine speed indicates a sudden deceleration, the value of the deceleration mode term $D_X$ is reset, in step 24, at a value $D_{X1}$ (e.g., 70%) which is larger than the above-described value $D_{X0}$ in order to increase the charging efficiency, thus ending the execution of this program.

If the result of the decision in step 23 is negative (No), that is, if the degree of deceleration of the engine speed indicates a slow deceleration operation, step 24 is skipped, and the execution of this program is ended.

If the result of the decision in step 22 is negative (No), the subsequent steps 23 and 24 are skipped, and the execution of this program is ended. For the following reason, step 22 is provided in the stage previous to steps 23 and 24 and the steps infra step 23 are executed only when the result of the decision in step 22 is affirmative (Yes) as described above.

There are two cases where shifting of the engine operation state from an operating state, wherein the control valve is to be controlled by the stop mode in the preceding loop, to an operating state, wherein the control valve is to be controlled by the deceleration mode in the present loop. In one of the cases, the engine operating state shifts from an operating state wherein the engine speed is higher than the above-described predetermined speed $N_A$ to an operating state wherein the control valve is to be controlled by the deceleration mode, due to the fact that the engine speed has been lowered by deceleration in which the throttle valve is fully closed. In the other case, the engine operating state shifts from a feedback control operation state wherein the control valve is controlled by the feedback mode during the idling operation to a stop mode operating state because the throttle valve is opened, and then shifts to a deceleration mode due to the fact that the throttle valve is fully closed again when the engine speed $N_e$ is lower than the predetermined speed $N_A$.

In the first described case, the rate of deceleration of the engine speed is largely affected according to whether or not the engine drive shaft is in engagement with the wheel, and the charging efficiency changes with the magnitude of the rate of deceleration of the engine speed. When the rate of deceleration of the engine is large, the engine is decelerated along an operation line III of FIG. 4 due to a reduction in the charging efficiency, despite the fact that the engine is supplied with an amount of auxiliary air corresponding to the valve-opening duty ration $D_{X0}$ as in the case of the operation line II of FIG. 4. This provides the same effect as when the engine is not supplied with auxiliary air by the deceleration mode immediately before engine operating state shifts to the feedback control operation state. For this reason, overshooting of the engine speed occurs in a manner similar to that of engine operating changes along the operation line I of FIG. 4. Therefore, in step 23, the rate of deceleration of the engine speed is determined, and when the rate of deceleration is large, the value of the valve-opening duty ratio $D_X$ is set at a value $D_{X1}$ which is larger than the value $D_{X0}$ set in step 21, whereby the engine speed is shifted to the idling point A of the target idling speed along an operation line IV of FIG. 4.

On the other hand, in the second described case, the degree of deceleration of the engine speed is sufficiently small so that the charging efficiency is not lowered. In this case, therefore, it is not necessary to set the value of the valve-opening duty ratio $D_X$ at the value $D_{X1}$. For this reason, the execution of subsequent steps 23 and 24 is omitted as described above.

Further, if the result of the decision in step 20 is negative (No), since the $D_X$ value has already been set in the preceding loop, it is not necessary to set the $D_X$ again, and the execution of this program is ended without executing subsequent steps 21 to 24. Thus, once the valve-opening duty ratio $D_X$ is set, the set value is maintained until the feedback control is commenced.

FIG. 6 is a flow chart of the $D_{PIn}$ determination subroutine executed in step 10 of FIG. 3. According to this program, first a decision is made as to whether or not the feedback control of the idling speed was effected at the time when the preceding TDC signal pulse was inputted (step 30). If the result of decision is negative (No), the feedback mode term $D_{PIn-1}$ for the preceding loop is set at the value of the deceleration mode term $D_X$ set in step 21 or 24 of FIG. 4 (step 31). If the result of decision in step 30 is affirmative (Yes), the feedback mode term $D_{PIn-1}$ in the preceding loop is applied as the $D_{PIn-1}$ value (step 32).

After the $D_{PIn-1}$ value has been set as described above, the process proceeds to step 33, in which the deviation of the actual engine speed $N_e$ from the target idling speed $N_H$ is obtained. This deviation is, in practice, obtained as the difference $\Delta M_n$ between a value $M_e$ which is proportional to the reciprocal of the engine speed $N_e$ and a value $M_H$ which is proportional to the reciprocal of the target idling speed $N_H$.

Next, an integral control term $\Delta D_I$ is obtained by multiplying the deviation value $\Delta M_n$ by a predetermined number $K_I$ (step 34). Further, the difference is obtained between the deviation value $\Delta M_n$ obtained in step 33 and the deviation value $\Delta M_{n-1}$ in the preceding loop, that is, an acceleration deviation value $\Delta\Delta M_n$ (step 35). Then, a proportional control term $\Delta D_P$ is obtained by multiplying the acceleration deviation value $\Delta\Delta M_n$ by a predetermined number $K_P$ (step 36). A value obtained by adding the control value $D_{PIn-1}$ for the preceding loop to the thus obtained integral control term $\Delta D_I$ and proportional control term $\Delta D_P$ is set as the feedback mode term $D_{PIn}$ for the present loop (step 31), thus ending the execution of this program.

Thus, since step 31 is provided, the valve-opening duty ratio $D_{OUT}$ in the control by the feedback mode is calculated with the value of the deceleration mode term $D_X$, that is the $D_{X0}$ or $D_{X1}$ value, as the initial value, whereby it is possible to smoothly shift the control from the deceleration mode to the feedback mode.

It is to be noted that, although, in the above-described embodiment, either one of the $D_{X0}$ value and the $D_{X1}$ value is selected as the value of the deceleration mode term $D_X$, it is, as a matter of course, possible to provide a multiplicity of set values $D_{Xi}$ and to finely select one of the $D_{Xi}$ values in accordance with the rate of deceleration.

As has been described above, according to the internal combustion engine idling speed feedback control method of the present invention an engine speed is detected, the rate of deceleration of the engine speed is detected at the time when the detected engine speed becomes lower than a predetermined speed while the engine is in an deceleration state; an initial value of the operation amount of the intake air amount control means in the idling speed feedback control is set in accordance with the detected rate of deceleration; and the initial value is maintained from the time when the engine speed becomes lower than the predetermined speed to the time when the feedback control is commenced. Therefore, it is possible to smoothly start the idling speed feedback control, so that engine operation performance is improved and there is no fear of engine stall during deceleration.

The present invention may be embodied in other specific forms without departing from the spirit or essential charateristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A method of feedback controlling idling speed in an internal combustion engine having an intake air amount control means for controlling the amount of air intake wherein, during an idling operation said intake air amount control means is feedback controlled as a function of the deviation of actual engine speed from a target engine speed, and wherein when the engine speed becomes lower than a predetermined speed while said engine is decelerating, said intake air amount control means is set to an initial value prior to or at the start of the feedback control, said method including the steps of detecting the engine speed; detecting the rate of deceleration of the engine when the detected engine speed becomes lower than the predetermined speed while the engine is decelerating; and setting the initial value of said intake air amount control means as a function of the rate of deceleration.

2. A method of feedback controlling idling speed as set forth in claim 1, including maintaining said intake air amount control means at the initial value during the period of time from when the engine speed becomes lower than the predetermined speed to when the feedback control starts.

3. A method of feedback controlling idling speed as set forth in claim 2, wherein the feedback control starts when the engine speed reaches the target speed.

4. A method of feedback controlling idling speed in an internal combustion engine having an intake air amount control means for controlling the amount of air intake, wherein during an idling operation said intake air amount control means is feedback controlled as a function of the deviation of actual engine speed from a target engine speed, and wherein when the engine speed becomes lower than a predetermined speed while the engine is decelerating, a predetermined amount of air is provided by said intake air amount control means, said method comprising the steps of detecting the engine speed; detecting the rate of deceleration of the engine when the detected engine speed becomes lower than the predetermined speed while the engine is decelerating and setting the predetermined amount of air as a function of the rate of deceleration.

* * * * *